US008047851B1

(12) United States Patent
Baxter

(10) Patent No.: US 8,047,851 B1
(45) Date of Patent: Nov. 1, 2011

(54) BULLETIN BOARD ORGANIZER

(76) Inventor: Tracy Baxter, Patterson, NY (US)

( * ) Notice: Subject to any disclaimer, the term of this patent is extended or adjusted under 35 U.S.C. 154(b) by 371 days.

(21) Appl. No.: 12/315,602

(22) Filed: Dec. 4, 2008

(51) Int. Cl.
*B43L 1/00* (2006.01)

(52) U.S. Cl. ..... 434/408

(58) Field of Classification Search ..... 434/365, 434/408, 413, 414, 419, 421, 425, 428, 429; 40/492, 493
See application file for complete search history.

(56) References Cited

U.S. PATENT DOCUMENTS

| | | | | | |
|---|---|---|---|---|---|
| 98,458 | A | * | 12/1869 | Bowman | 434/422 |
| 627,396 | A | * | 6/1899 | Daly | 434/413 |
| 2,655,740 | A | * | 10/1953 | Goodrich | 434/414 |
| 3,107,442 | A | | 10/1963 | Levine | |
| 3,629,960 | A | * | 12/1971 | Roush | 434/429 |
| D274,589 | S | | 7/1984 | Christensen et al. | |
| 4,545,768 | A | * | 10/1985 | Hinnen | 434/304 |
| D281,704 | S | | 12/1985 | Deacon | |
| 4,828,502 | A | * | 5/1989 | Leahy | 434/416 |
| 5,131,849 | A | * | 7/1992 | Perrero | 434/281 |
| 5,161,321 | A | * | 11/1992 | Kuhnke | 40/493 |
| 5,658,635 | A | | 8/1997 | Davis et al. | |
| 5,682,695 | A | | 11/1997 | Hoffman | |
| D417,701 | S | | 12/1999 | Jack | |
| 6,139,331 | A | * | 10/2000 | Owen | 434/408 |
| 6,779,286 | B2 | * | 8/2004 | Shaffer et al. | 40/606.16 |
| 6,854,202 | B1 | * | 2/2005 | Ives et al. | 40/491 |
| 7,040,899 | B2 | * | 5/2006 | Armstrong | 434/430 |
| 7,260,904 | B1 | | 8/2007 | Boisseau | |
| 2006/0000790 | A1 | | 1/2006 | Smiddy et al. | |
| 2006/0059734 | A1 | | 3/2006 | Van Drie | |
| 2006/0225331 | A1 | | 10/2006 | Evans | |
| 2007/0077815 | A1 | | 4/2007 | White et al. | |

* cited by examiner

*Primary Examiner* — Kurt Fernstrom
(74) *Attorney, Agent, or Firm* — Montgomery Patent & Design; Robert C. Montgomery; Joseph T. Yaknih

(57) ABSTRACT

A wall-mounted storage and organization organizer for notes, memos, calendars, business cards, reminders, keys and the like, comprising a multi-door cabinet is herein disclosed. The organizer has approximate dimensions of twenty-eight (28) inches in height, twenty (20) inches in width, and three (3) inches in depth. The front door is provided with a clear pane under which photographs, calendars and the like can be placed on a second door in a neat manner for all to see without opening the outer door. When additional doors of the organizer are opened, additional organizational spaces are provided. The organizer further provides cork board surfaces and white board surfaces as well as a magnetic tray for holding dry erase markers and an eraser. Such surfaces would allow users to leave themselves or others messages or large notes. The rearmost door provides a mounting means thereto a wall surface and provides a series of varying sized pockets capable of holding small business cards up to a large sheet of paper. Such pockets would be used to organize lists, appointment reminders, additional calendars, photographs and the like. Finally, the rear surface provides a plurality of hooks used to hold keys, ID tags and other similar items.

15 Claims, 7 Drawing Sheets

BULLETIN BOARD ORGANIZER

RELATED APPLICATIONS

The present invention was first described in a notarized Official Record of Invention on Feb. 25, 2008, that is on file at the offices of Montgomery Patent and Design, LLC, the entire disclosures of which are incorporated herein by reference.

FIELD OF THE INVENTION

The present invention relates generally to a bulletin board organizer apparatus and, more particularly, to said apparatus comprising a front panel providing a transparent window under which photographs can be placed on a panel in a manner for all to see without opening the front panel, a plurality of corkboard surfaces and a plurality of whiteboard surfaces for leaving messages or notes, a magnetic tray for holding dry erase markers and an eraser, and a rear panel providing a mounting means thereto a wall surface and providing a plurality of storage compartments and a plurality of hook fixtures.

BACKGROUND OF THE INVENTION

In many homes, the refrigerator ends up as the collection place for documents such as a child's school work, calendars, meeting reminders, telephone numbers, and photographs. These papers are typically held in place with a magnet or two (2) adhering to the metal surface. While such a method typically works, it is burdened with a few disadvantages. First the magnets are prone to falling off, especially with heavy or larger pieces of paper. Secondly, air from wind movement or simply walking by can get under the paper causing it to be dislodged and fall to the floor. Finally, papers are often lost amongst the utility bills, doctor visit reminders, calendars and everything else found on a typical refrigerator. These same problems exist in an office environment where bulletin boards can be even worse and nothing can be found. Accordingly, there exists a need for a means by which important papers, documents, reminders and the like can be easily found without the disadvantages as described above. The development of the apparatus herein described fulfills this need.

Cork boards are also frequently used for maintaining papers in kitchens. As with the refrigerator magnets situation described above, the papers are prone to falling from a cork board. Also, cork boards can lend an untidy appearance to one's kitchen. The apparatus described herein eliminates the untidiness of cork boards while retaining the functionality of a corkboard.

There have been attempts in the past to invent wall-mounted organizing systems. U.S. Pat. No. 7,260,904 issued to Boisseau discloses a flat calendar wall-mounted system that comprises a white board, a calendar, and a cork board. Unfortunately, this patent does not appear to disclose a plurality of panel assemblies that are connected by hinges and capable of foldably compacting or opening to reveal a cabinet like structure with various sized compartments and hooks for holding items.

U.S. Patent Application Number 2007/0077815 filed by White et al. discloses discreet messaging center and organizers that appear to be capable of being fitted together to form a modular message center. Unfortunately, this patent does not appear to disclose a plurality of panel assemblies that comprise a white board or a cork board surface that are hingedly connected to a cabinet-like structure.

U.S. Patent Application Number 2006/0225331 filed by Evans discloses a household organizer that appears to comprise a display board with two foldable sections. Unfortunately, this application does not appear to disclose a cabinet like structure in which all of the panel assemblies fold from one (1) side nor, does it appear to comprise an outermost panel that is capable of accepting pictures or other decorative items behind a window.

U.S. Pat. No. D 417,701 issued to Jack discloses what appears to be a wall-mounted white board and cork board combination with a shelf for a pen and/or an eraser. Unfortunately, this design patent does not appear to be similar in appearance to the disclosed apparatus, nor does it appear to comprise several panel assemblies that are foldable upon one (1) another to conserve space on a wall.

U.S. Pat. No. 5,682,695 issued to Hoffman discloses a combination presentation organizer that appears to be a portable display for a bulletin board or white board and that provides various attachments means to a wall. Unfortunately, this patent does not appear to disclose a plurality of panel assemblies that comprise a white board or a cork board surface that are hingedly connected to a cabinet-like structure.

U.S. Pat. No. 5,658,635 issued to Davis et al. discloses a bulletin board further comprising an accessory attaching mechanism comprising a frame that accepts a "C"-shaped grip. Unfortunately, this patent does not appear to disclose a wall-mounted cabinet structure that comprises various sized compartments and hooks for storage of articles, nor does it appear to disclose a plurality of white board and cork board panels hingedly attached to said cabinet.

U.S. Pat. No. D 281,704 issued to Deacon discloses a combined bulletin board, telephone book and pad holder that appears to be wall-mounted. Unfortunately, this design patent does not appear to be similar in appearance to the disclosed apparatus, nor does it appear to comprise an organizer with a plurality of compartments and hooks contained within a cabinet like structure.

U.S. Pat. No. D 274,589 issued to Christensen et al discloses a wall mounted combined picture frame and bulletin board. Unfortunately, this design patent does not appear to be similar in appearance to the disclosed apparatus, nor does it appear to comprise several panel assemblies that are foldable upon one (1) another to conserve space on a wall.

U.S. Pat. No. 3,107,442 issued to Levine appears to disclose a free standing easel like structure with a rotatable cork board and accessory storage shelf. Unfortunately, this patent does not appear to disclose a wall-mounted cabinet structure that comprises various sized compartments and hooks for storage of articles.

None of the prior art particularly describes a bulletin board organizer comprising a front panel providing a transparent window under which photographs can be placed on a panel in a manner for all to see without opening the front panel, a plurality of corkboard surfaces and a plurality of whiteboard surfaces for leaving messages or notes, a magnetic tray for holding dry erase markers and an eraser, and a rear panel providing a mounting means thereto a wall surface and providing a plurality of storage compartments and a plurality of hook fixtures that the instant invention possesses. Accordingly, there exists a need for a means by which important papers, documents, reminders, and the like can be easily found without the disadvantages as described above.

SUMMARY OF THE INVENTION

In light of the disadvantages as described above in the prior art, it is apparent that there is a need for a bulletin board organizer which provides a wall-mounted storage and organization apparatus for notes, memos, calendars, business cards, reminders, and keys.

An object of the bulletin board organizer is to provide a convenient and compact multi-compartmentalized organizer with many different functions.

Another object of the bulletin board organizer is to provide a white board for note writing, a cork board for pinning items, pockets to store papers and cards, and hooks upon which to hang keys, all of which are in a self-contained wall-mounted unit.

A further object of the bulletin board organizer provides, on the outermost panel, a clear surface under which decorative pictures, photographs, calendars and the like may be displayed in a neat manner without the need to open the organizer.

Still another object of the bulletin board organizer, when opened, provides various-sized rectangular top openings and provides convenient storage of items such as, business cards, pads of paper, post cards, and other miscellaneous items.

Still a further object of the bulletin board organizer provides a plurality of hook fixtures affixed to the first panel and provides convenient storage of items such as keys, identification tags and other similar items.

Yet another object of the bulletin board organizer provides cork board surfaces which hold reminders, and a white board having a tray holding dry erase markers and an eraser.

Yet still another object of the bulletin board organizer comprises a magnetic accessory tray affixed to the white-board surface comprising a plastic open-topped rectangular receptacle which may be mounted anywhere along said second panel or completely removed due to said magnetic properties.

Another object of the bulletin board organizer comprises panel assemblies made of durable and washable plastic-coated metallic panels similar to popular magnetic white boards.

An aspect of the bulletin board organizer comprises a wall-mountable box-shaped first panel assembly and a plurality of attached hinging panels.

Another aspect of the bulletin board organizer comprises a shallow cabinet and further comprising a first panel assembly, a second panel assembly, a third panel assembly, a fourth panel assembly, a plurality of hinges, and a transparent window.

A further aspect of the bulletin board organizer comprises a first panel assembly further comprising a shallow open-faced box-like structure with three (3) stationary side surfaces, a vertical first panel, and a first hinge. The first panel assembly comprises a means to attach the apparatus to a wall surface via four (4) keyhole-shaped mounting apertures. The first panel assembly comprises a plurality of small storage compartments and a plurality of hook fixtures. The first panel assembly is attached to the second panel assembly via a first hinge.

Still another aspect of the bulletin board organizer comprises a first hinge comprising a compound offset rotating metal device further comprising a pair of mounting flanges, a pair of rotating axle members and a connecting offset plate. The first hinge is a compound offset device which allows the organizer to transform from a closed rectangular box to a fully opened state by pivoting a full one-hundred eighty degrees (180°).

Still a further aspect of the bulletin board organizer comprises a second panel assembly comprising a second panel, a metallic first frame portion, and an accessory tray. The second panel comprises a common plastic whiteboard surface on one (1) side being suitable for dry-erase markers and a corkboard surface bonded to an opposite side.

Yet still another aspect of the bulletin board organizer comprises an accessory tray which provides a receptacle for various whiteboard utensils including pens and erasers.

Yet another aspect of the bulletin board organizer comprises a first frame portion comprising a three (3) sided channel-shaped border encompassing four (4) outer edges of the second panel assembly and joined at intersecting corner regions.

Still another aspect of the bulletin board organizer comprises a second panel assembly and a third panel assembly providing respective second and third panels. The second panel and third panel comprise magnetic white boards similar to the first panel. The second and third panel assemblies are attached to one another via a centrally located vertical second hinge.

Still a further aspect of the bulletin board organizer comprises a third panel assembly comprising a second frame portion which provides a reversing means to the third panel allowing upward extraction and replacement of said second panel and allowing display of a white-board surface.

Yet another aspect of the bulletin board organizer comprises a second frame portion which provides a magnetic attraction means to the magnetic strip portion of the fourth panel assembly. A vertical second hinge provides an attachment between the first and second frame portions. The second and third hinges comprise common metal piano-type hinges affixed to first, second, and third frame portions.

Yet a further aspect of the bulletin board organizer comprises a third panel assembly that is attached to the fourth panel assembly and further comprises a white board surface.

Yet still another aspect of the bulletin board organizer comprises a fourth panel assembly comprising a magnetic strip, a third frame portion, and a transparent window. The magnetic strip is affixed to the third frame portion in a picture-frame manner. The fourth panel assembly pivots about the third hinge to abut against the third panel assembly and is held in a closed position by the magnetic strip on the second frame portion.

Yet another aspect of the bulletin board organizer comprises a transparent window comprising a clear rectangular plastic pane providing a transparent washable and protective viewing surface to observe decorative display items affixed to the third panel.

A method of installing and utilizing the organizer may be achieved by performing the following steps: locating a wall surface in a home or office offering convenient viewing; mounting the organizer upon said wall surface in a conventional manner utilizing the mounting apertures and common purchased fastening hardware such as wall anchors, screws, or the like; displaying the first panel assembly by pivoting the second panel assembly outwardly to a left-hand position; utilizing the compartment and hook fixture features of said first panel assembly as previously described; mounting the magnetic accessory tray to the white-board surface of the second panel; loading desired white-board supplies and utensils into said accessory tray such as markers and erasers; pivoting the second panel assembly to a right-hand position; displaying and utilizing the corkboard surface of the second and third panels of the apparatus to display various items such as calendars, photographs, messages, announcements, decorations, collages, artwork, and the like; utilizing said second and third panels individually or as a combined larger display surface to affix said items using thumb tacks or push-pins; reversing the third panel, if desired, by upwardly extracting, rotating, and reinserting said third panel into the slot to allow utilization of the white-board surface portion of the third panel in an expected manner; pivoting the third panel assembly to a right-hand and forward facing position to expose the white-board surface of the third panel; mounting and displaying decorative items such pictures, artwork items, photos, or the like thereupon the third panel using tape, magnets, or other temporary fasteners; pivoting the fourth panel assembly to a right-hand position until attached against the third panel assembly via the magnetic strip, thereby returning the organizer to a closed state; viewing various display items through the transparent window portion; and benefiting from an aesthetic and compact multi-functional communication center using the organizer.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
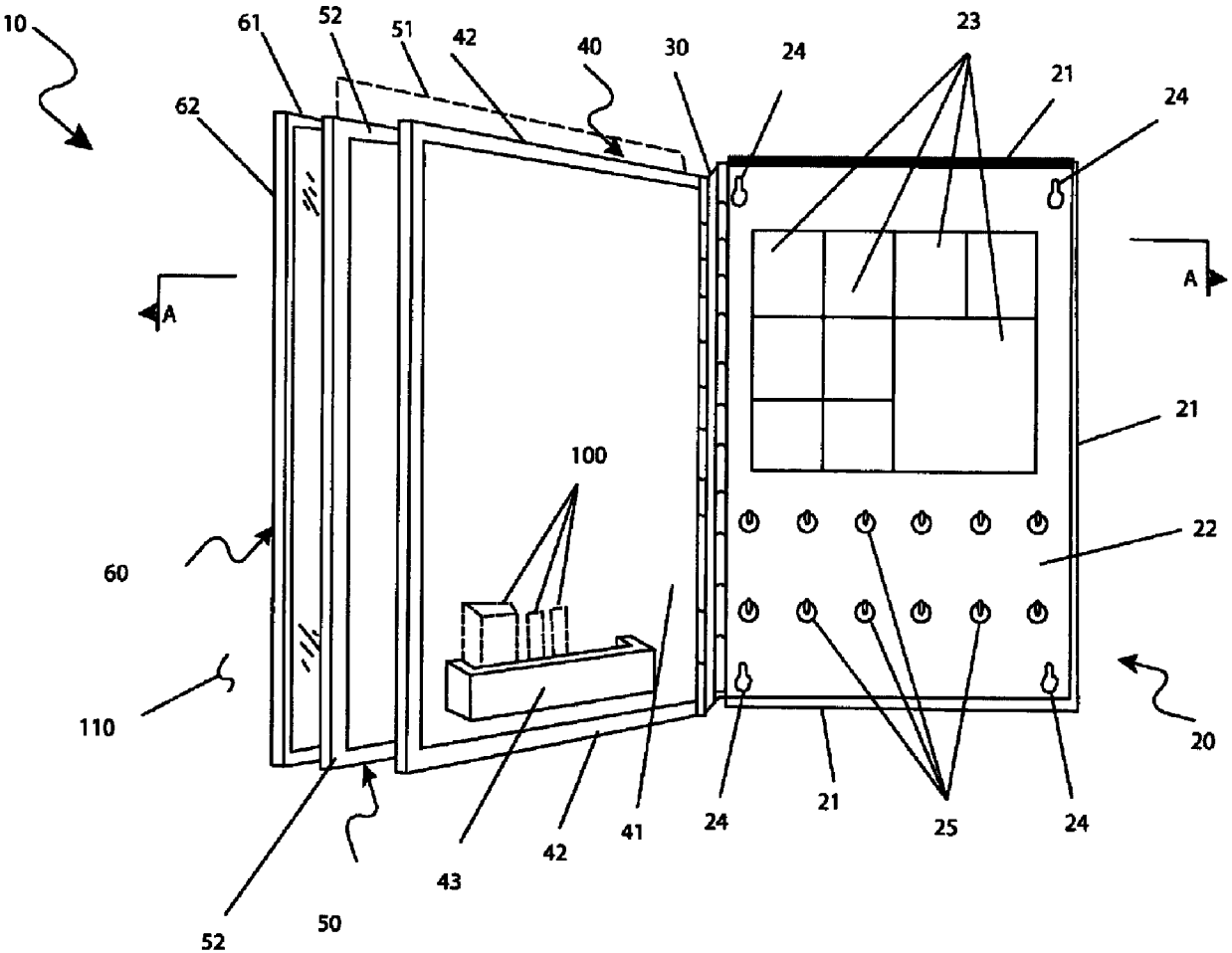
FIG. 1 is a front perspective view of a bulletin board organizer 10 depicting an open state and first panel assembly 20, according to a preferred embodiment of the present invention.

| | |
|---|---|
| 10 | bulletin board organizer |
| 20 | first panel assembly |
| 21 | first panel side |
| 22 | first panel |
| 23 | compartment |
| 24 | mounting aperture |
| 25 | hook fixture |
| 30 | first hinge |
| 31 | flange |
| 32 | axle |
| 33 | offset plate |
| 35 | second hinge |
| 36 | third hinge |
| 40 | second panel assembly |
| 41 | second panel |
| 42 | first frame portion |
| 43 | accessory tray |
| 50 | third panel assembly |
| 51 | third panel |
| 52 | second frame portion |

-continued

| | |
|---|---|
| 54 | display item |
| 55 | slot |
| 60 | fourth panel assembly |
| 61 | magnetic strip |
| 62 | third frame portion |
| 63 | transparent window |
| 100 | utensil |
| 110 | wall surface |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a bulletin board organizer (herein described as the "apparatus") 10, which provides a wall-mounted storage and organization apparatus 10 for notes, memos, calendars, business cards, reminders, keys, and the like. The apparatus 10 comprises a wall mountable box-shaped first panel assembly 20 and a plurality of attached hinging panels. When closed, the outermost panel provides a clear surface under which decorative pictures, photographs, calendars and the like may be displayed in a neat manner for all to see without opening the apparatus 10. When the panels are opened, additional organizational spaces and surface types are available including a plurality of varying sized compartments 23 capable of holding small business cards up to large sheets of paper. The apparatus 10 also provides a plurality of hooks 25 used to hold keys, ID tags, and other similar items. Additionally, the hinged panels provide cork board surfaces which hold reminders, and a white board having a tray 43 for holding dry erase markers and an eraser 100.

Referring now to FIG. 1, a front perspective view of the apparatus 10 depicting a first panel portion 20, according to a preferred embodiment of the present invention, is disclosed. The apparatus 10 comprises a first panel assembly 20, a first hinge 30, and a second panel assembly 40. The panel assemblies 20, 40 are envisioned being made of durable and washable plastic coated metallic panels being similar to popular magnetic white boards. The apparatus 10 takes a form of a shallow cabinet having approximate dimensions of twenty-eight (28) inches in height, twenty (20) inches in width, and three (3) inches in depth. The first panel assembly 20 provides a means to attach the apparatus 10 thereto a wall surface 110 via four (4) keyhole-shaped mounting apertures 24 at inside corner locations. The first panel assembly 20 comprises a plurality of small storage compartments 23 and a plurality of hook fixtures 25 (see FIG. 5). The first panel assembly 20 provides an attachment means thereto the second panel assembly 40 via a first hinge 30. The first hinge 30 comprises a compound offset device allowing the apparatus 10 to transform therefrom a closed rectangular box form (see FIG. 2*c*), thereto a fully opened state by pivoting a full one-hundred eighty degrees (180°) about axial elements of said first hinge 30 (see FIG. 4). The second panel assembly 40 comprises a second panel 41, a metallic first frame portion 42, and an accessory tray 43. The second panel 41 comprises a common plastic whiteboard surface on one (1) side being suitable for dry-erase markers being common in the industry and a cork-board surface bonded thereto an opposite side thereof (see FIG. 2*a*). Such surfaces would allow the user to communicate large notes and/or messages thereto themselves, or others. Affixed thereto the white-board surface of the second panel 41 is a magnetic accessory tray 43 comprising a plastic open-topped rectangular receptacle which may be mounted anywhere along said second panel 41 or completely removed due to said magnetic properties. The accessory tray 43 provides a receptacle for various whiteboard utensils 100 such as markers, spray cleanser, erasers, and the like. The first frame portion 42 provides a three (3) sided channel-shaped border encompassing four (4) outer edges of the second panel assembly 40 and being joined thereat intersecting corner regions using metal joining processes such as welding, soldering, interlocking features, or the like. The first frame portion 42 is envisioned to be made using rugged formed or extruded plated steel channel.

Figure 2A:
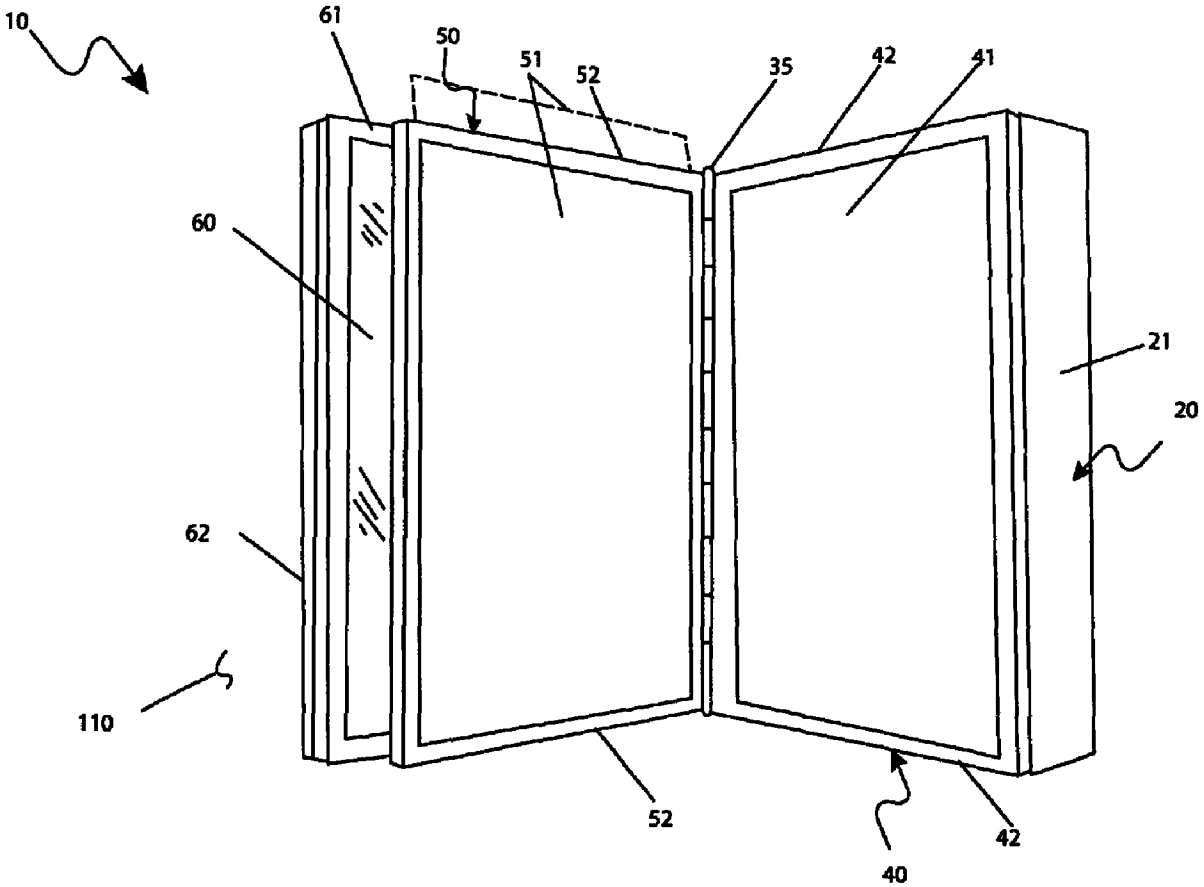
FIG. 2*a* is a front perspective view of a bulletin board organizer 10 depicting a second panel assembly 40 and a third panel assembly 50, according to a preferred embodiment of the present invention.

Referring now to FIG. 2*a*, a perspective view of the apparatus 10 depicting a second panel assembly 40 and a third panel assembly 50, according to a preferred embodiment of the present invention, is disclosed. The apparatus 10 comprises a second panel assembly 40 and a third panel assembly 50 providing respective second 41 and third 51 panels. Both the second panel 41 and third panel 51 comprise magnetic white boards providing similar materials and construction as the aforementioned first panel 22; however, further comprise a common corkboard layer being bonded thereto a single side portion as shown here using common adhesives. The second 40 and third 50 panel assemblies provide an attachment means thereto one another via a centrally located vertical second hinge 35. When in an open state (as shown here), the second panel assembly 40 and a third panel assembly 50 may be utilized individually or as a combined larger display surface to affix various items using thumb tacks or push-pins such as, but not limited to: calendars, photographs, messages, announcements, decorations, collages, artwork, and the like. The third panel assembly 50 comprises a second frame portion 52 providing similar construction and materials as the aforementioned first frame portion 42; however, said second frame portion 52 provides a reversing means thereto the third panel 51 via a slot 55 along a top surface of the second frame portion 52 allowing upward extraction and replacement of said second panel 51 allowing display of a white-board surface, if desired. The second frame portion 52 also provides a magnetic attraction means thereto the magnetic strip portion 61 of the fourth panel assembly 60 (see FIG. 2*b*). The vertical second hinge 35 provides an attachment means therebetween the first 42 and second 52 frame portions using common joining processes (see FIGS. 3 and 4).

Figure 2B:
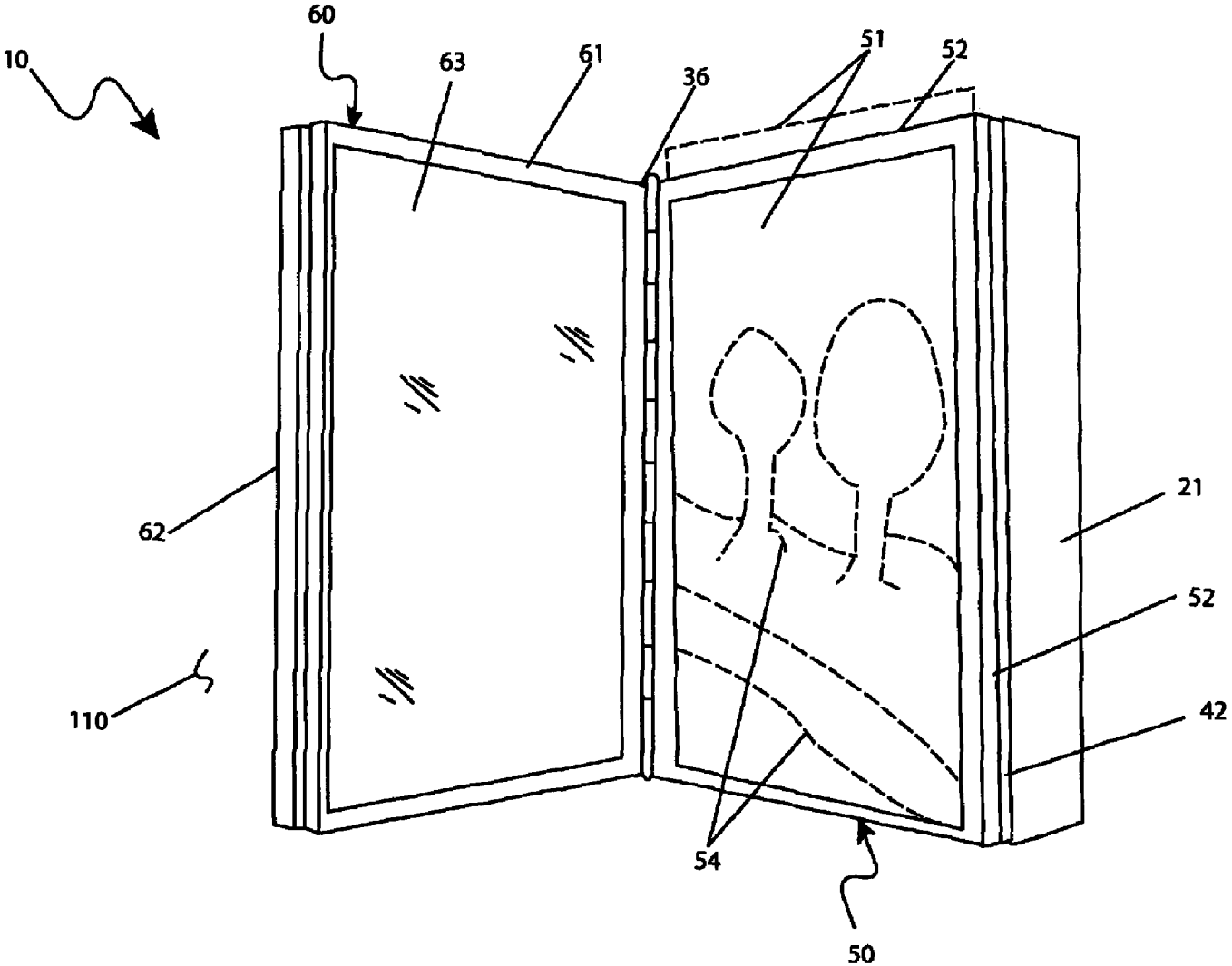
FIG. 2*b* is a front perspective view of a bulletin board organizer 10 depicting a third panel assembly 50 and a fourth panel assembly 60, according to a preferred embodiment of the present invention.

Referring now to FIG. 2*b*, a front perspective view of a bulletin board organizer 10 depicting a third panel assembly 50 and fourth panel assembly 60, according to a preferred embodiment of the present invention, is disclosed. The third panel assembly 50 further comprises a white board surface as shown here to present one (1) or more display items 54 affixed thereto (see FIG. 2*c*). The third panel assembly 50 provides an attachment means thereto the fourth panel assembly 60 along a common vertical edge region via a third hinge 36. The third hinge 36 extends an entire joined edge of said panel assemblies 50, 60 (see FIGS. 3 and 4). The fourth panel assembly 60 comprises a magnetic strip 61, a third frame portion 62, and a transparent window 63. The third frame portion 62 comprises similar materials and construction as the previously described first 42 and second 52 frame portions. The magnetic strip 61 is envisioned to be made using a common conductive polymer type material approximately one-half (½) inch wide and one-eighth (⅛) inch thick being affixed thereto the third frame portion 62 in a picture-frame manner using common adhesives. In use, the fourth panel assembly 60 is pivoted about the third hinge 36 to abut against the third panel assembly 50 being firmly held in a closed position by the magnetic attraction of the magnetic strip 61 thereto the second frame portion 52 (see FIG. 2*c*). The transparent window 63 comprises a clear rectangular plastic pane envisioned to be made using acrylic glass, Lexan®, or equivalent materials, thereby providing a transparent washable and protective viewing surface to observe decorative display items 54 affixed thereto the third panel 51 as previously described.

Figure 2C:
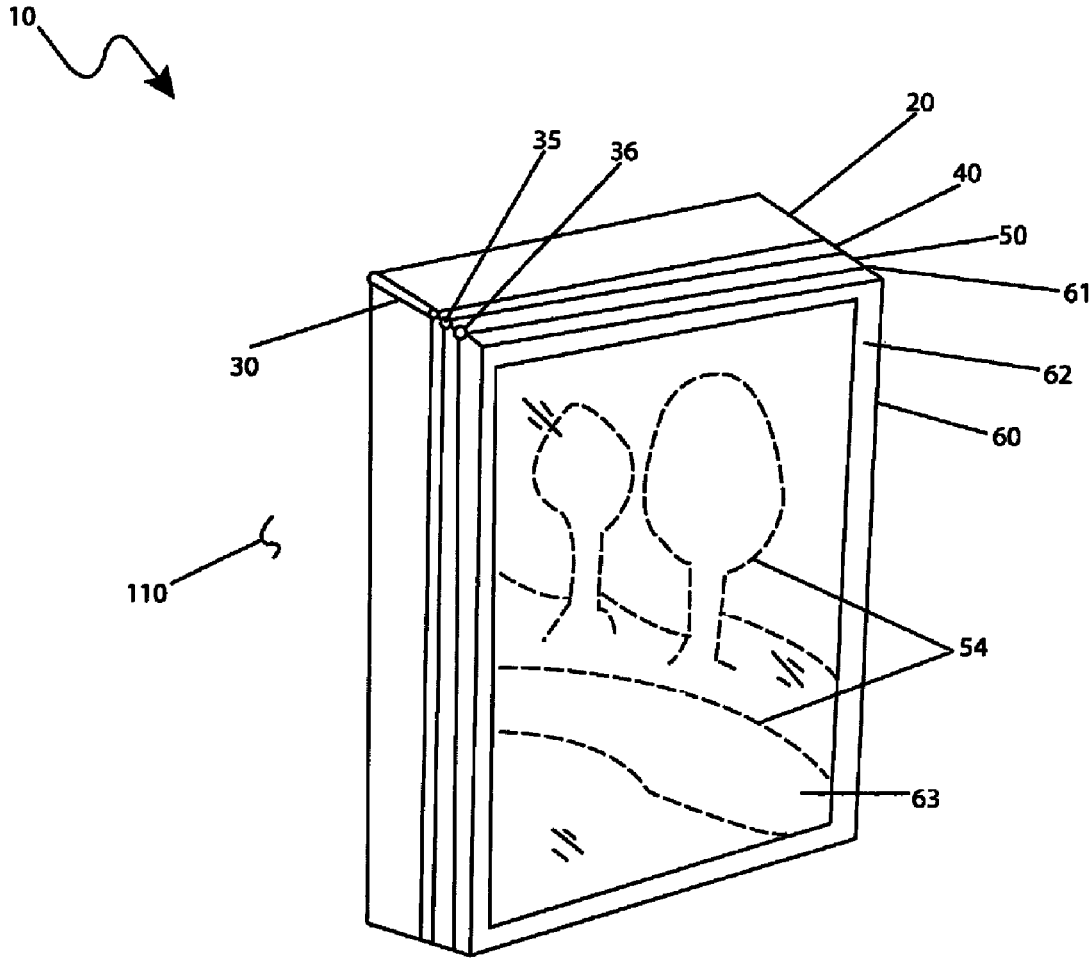
FIG. 2*c* is a front perspective view of a bulletin board organizer 10 depicting a closed state, according to a preferred embodiment of the present invention.

Referring now to FIG. 2*c*, a front perspective view of the apparatus 10 depicting a closed state, according to a preferred embodiment of the present invention, is disclosed. The apparatus 10 is illustrated here being attached thereto a wall surface 110 and depicting a normal closed or stored state showing an attractive display item 54 as seen therethrough the transparent window 63 of the fourth panel assembly 60. The third panel 51 provides a presentation means thereto one (1) or more display items 54 when the apparatus 10 is in a closed state. Said display items 54 are envisioned to be affixed thereto using common adhesive tape or magnetic strips. Said display items 54 are envisioned to include visually attractive items such as, but not limited to: decorative pictures, artwork items, photos, or the like, thereby providing an aesthetic visual effect. The third panel 51 may also be decorated by a user using dry erase markers 100 in an expected manner to provide additional artwork or to communicate a message. Additionally, said third panel 51 may be reversed as previously described, to expose a cork-board surface allowing attachment and presentation of various artwork and/or communication forms using thumb tacks.

Figure 3:
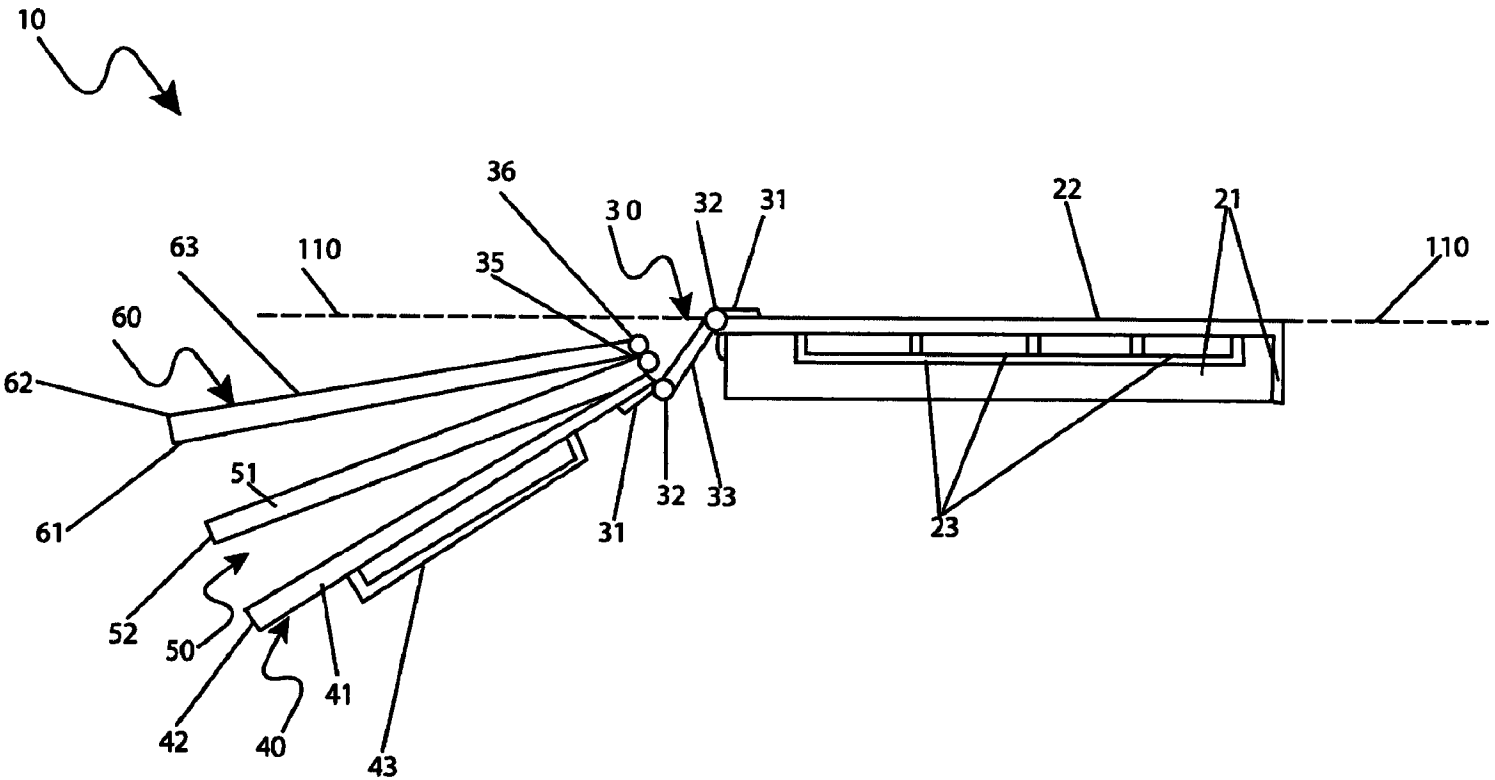
FIG. 3 is a section view taken along section line A-A (see FIG. 1) of a bulletin board organizer 10, according to a preferred embodiment of the present invention.
Figure 4:
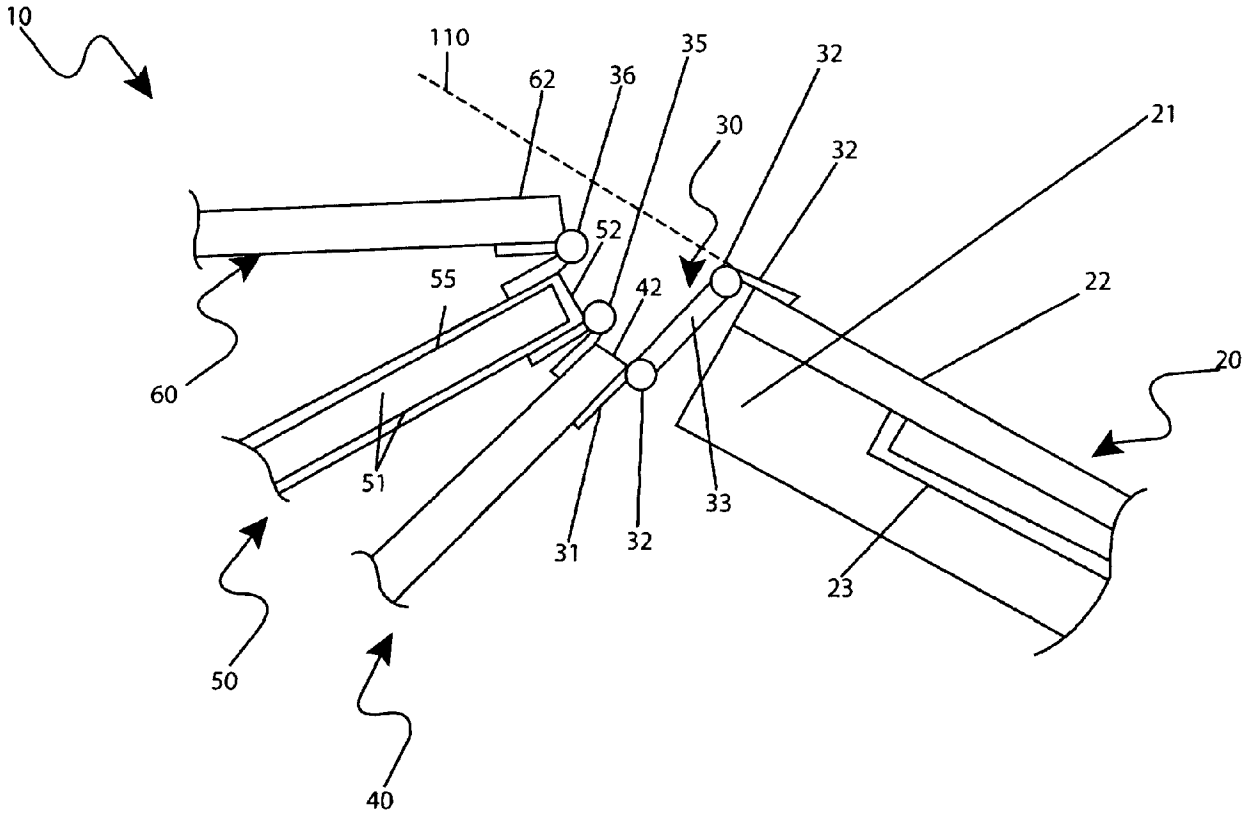
FIG. 4 is a close-up view of a hinging portion of the bulletin board organizer 10, according to a preferred embodiment of the present invention; and, FIG. 5 is a perspective view of a first panel assembly portion 20 of the bulletin board organizer 10, according to a preferred embodiment of the present invention.

Referring now to FIGS. 3 and 4, sectional and close-up views of the apparatus 10, according to a preferred embodiment of the present invention, are disclosed. FIG. 3 illustrates a section view taken along section line A-A (see FIG. 1) showing relative positions therebetween the panel assemblies 20, 40, 50, 60 being hingedly attached thereto one another via the hinges 30, 35, 36 in a partially opened state. FIG. 4 provides a close-up view of the hinge portions 30, 35, 36 of the apparatus 10. The first hinge 30 comprises a compound offset rotating metal device further comprising a pair of mounting flanges 31, a pair of rotating axle members 32 and a connecting offset plate 33. The vertical flange portions 31 comprise extending and rotating flat appendages providing a joining means therebetween the first panel assembly 20 and second panel assembly 40. The mounting flanges 31 are affixed thereto the first panel side portion 21 of the first panel assembly 20 and the first frame portion 42 of the second panel assembly 40 using durable metal joining processes such as, but not limited to: spot welding, soldering, or the like. The second 35 and third 36 hinges comprise common metal piano-type hinges being affixed thereto respective first 42, second 52, and third 62 frame portions utilizing like metal joining processes as the aforementioned first hinge 30.

Figure 5:
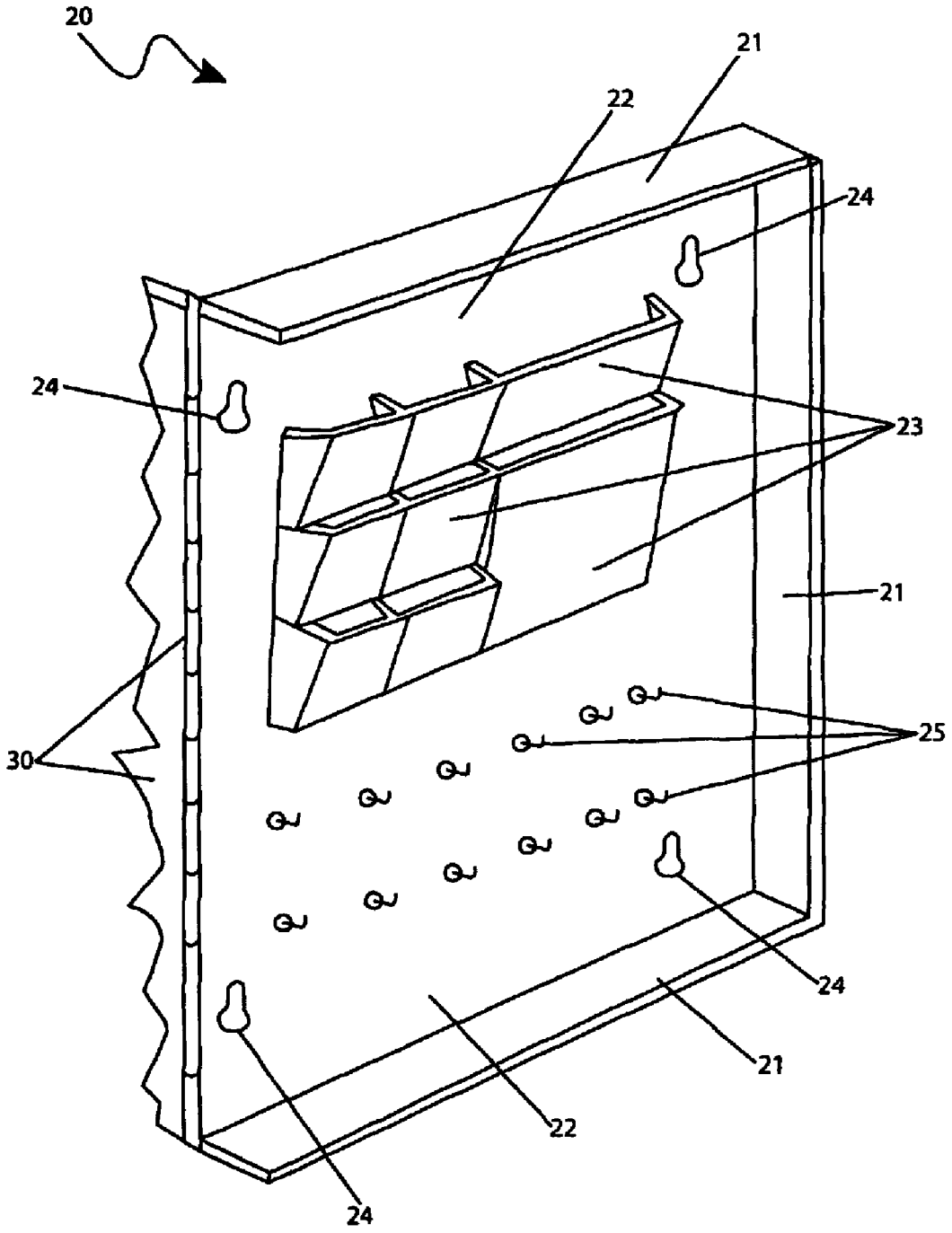

Referring now to FIG. 5, a perspective view of the first panel assembly portion 20 of the apparatus 10, according to a preferred embodiment of the present invention, is disclosed. The first panel assembly 20 provides a shallow open-faced box-like structure approximately twenty-eight (28) inches in height, twenty (20) inches in width, and two (2) inches deep. The first panel assembly 20 comprises three (3) stationary side surfaces 21, an included vertical first panel 22, and a first hinge 30 along one (1) vertical edge. When the apparatus 10 is in the closed state, the offset plate portion 33 of the first hinge 30 provides a rotating fourth side surface thereto the first panel assembly 20. The first panel assembly 20 comprises particular enhanced features arranged along the first panel portion 22 including a plurality of rectangular storage compartments 23, and a plurality of hook fixtures 25. The compartments 23 comprise various sizes having rectangular top openings and taping downwardly, thereby providing convenient storage of items such as, but not limited to: business cards, pads of paper, post cards, miscellaneous items, and the like. The compartments 23 would also be used to organize lists, appointment reminders, additional calendars, photographs and the like. The hook fixtures 25 comprise common brass or steel hanging fixtures affixed thereto the first panel 22 using threaded appendages in a conventional manner and being arranged in an equally-spaced manner along two (2) parallel rows, thereby providing convenient storage of items such as keys, identification tags and other similar items.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2*c*.

The method of installing and utilizing the apparatus 10 may be achieved by performing the following steps: locating a wall surface 110 therein a home or office offering convenient viewing; mounting the apparatus 10 thereupon said wall surface 110 in a conventional manner utilizing the mounting apertures 24 and common purchased fastening hardware such as wall anchors, screws, or the like; displaying the first panel assembly 20 by pivoting the second panel assembly 40 outwardly to a left-hand position; utilizing the compartment 23 and hook fixture 25 features of said first panel assembly 20 as previously described; mounting the magnetic accessory tray 43 thereto the white-board surface of the second panel 41; loading desired white-board supplies and utensils 100 thereinto said accessory tray 43 such as markers and erasers 100; pivoting the second panel assembly 40 thereto a right-hand position; displaying and utilizing the corkboard surface of the second 41 and third 51 panels of the apparatus 10 to display various items such as calendars, photographs, messages, announcements, decorations, collages, artwork, and the like; utilizing said second 41 and third 51 panels individually or as a combined larger display surface to affix said items using thumb tacks or push-pins; reversing the third panel 51, if desired, by upwardly extracting, rotating, and reinserting said third panel 51 thereinto the slot 55 to allow utilization of the white-board surface portion of the third panel 51 in an expected manner; pivoting the third panel assembly 50 thereto a right-hand and forward facing position to expose the white-board surface of the third panel 51; mounting and displaying decorative items such pictures, artwork items, photos, or the like thereupon the third panel 51 using tape, magnets, or other temporary fasteners; pivoting the fourth panel assembly 60 thereto a right-hand position until attached thereagainst the third panel assembly 50 via the magnetic strip 61, thereby returning the apparatus 10 thereto a closed state; viewing various display items therethrough the transparent window portion 63; and benefiting from an aesthetic and compact multi-functional communication center using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A bulletin board organizer, comprising:

a first panel comprising a first panel front surface and a first panel rear surface;

a second panel hingedly connected to said first panel and comprising a second panel first surface and a second panel second surface facing said first panel front surface;

a third panel hingedly connected to said second panel and comprising a third panel first surface and a third panel second surface facing said second panel first surface; and, a fourth panel hingedly connected to said third panel and comprising a transparent window, thereby providing a viewing surface to observe a display item affixed to said third panel first surface;

wherein said organizer transforms from a fully closed form to a fully opened form by pivoting one-hundred eighty degrees; and, wherein said first panel is adapted to secure said organizer to a wall surface.

2. The organizer of claim 1, wherein said first panel front surface further comprises:

a plurality of storage compartments; and, a plurality of hook fixtures;

wherein said plurality of storage compartments provide storage of a variety of items; and, wherein said plurality of hook fixtures provide storage to a plurality of hanging items.

3. The organizer of claim 1, wherein said first panel further comprises at least one mounting aperture located on said first panel through said first panel front surface and said first panel rear surface.

4. The organizer of claim 1, wherein said second panel first surface further comprises a first corkboard surface.

5. The organizer of claim 1, wherein said second panel second surface further comprises:

a first whiteboard surface; and, a tray removably attachable to said first whiteboard surface;

wherein said first whiteboard surface is suitable for a dry-erase marker; and, wherein said tray can be mounted anywhere along said first whiteboard surface.

6. The organizer of claim 5, wherein said tray is removably attachable to said first whiteboard surface by a magnet.

7. The organizer of claim 1, wherein said second panel further comprises a first frame portion around an entire border region of said second panel.

8. The organizer of claim 1, wherein said third panel further comprises a second frame portion around an entire border region of said third panel.

9. The organizer of claim 8, wherein said third panel further comprises:

a reversible panel comprising a second corkboard surface on a front side and a second whiteboard surface on a rear side; and, a slot in a top surface of said second frame portion;

wherein said slot allows said reversible panel to be extracted and placed in said slot, thereby allowing display of said second corkboard surface or said second whiteboard surface as said third panel first surface or said third panel second surface.

10. The organizer of claim 1, wherein said fourth panel further comprises:

a third frame portion around an entire border region of said fourth panel; and, a magnetic strip affixed to a rear surface of said third frame portion, thereby providing a magnetic attraction with said second frame portion of said third panel.

11. The organizer of claim 10, wherein said magnetic strip is approximately one-half inch wide and one-eighth inch thick.

12. The organizer of claim 1, comprising a rectangular configuration approximately twenty-eight inches in height, twenty inches in width, and three inches in depth.

13. The apparatus of claim 1, wherein said first panel, said second panel, said third panel, and said fourth panel comprise a washable material.

14. The apparatus of claim 1, wherein said first panel, said second panel, said third panel, and said fourth panel comprise a plastic-coated metallic material.

15. A method for using a bulletin board organizer, said method comprising the steps of:

providing said organizer, comprising:

a first panel comprising a first panel front surface and a first panel rear surface;

a second panel hingedly connected to said first panel and comprising a second panel first surface and a second panel second surface facing said first panel front surface;

a third panel hingedly connected to said second panel and comprising a third panel first surface and a third panel second surface facing said second panel first surface; and, a fourth panel hingedly connected to said third panel and comprising a transparent window, thereby providing a viewing surface to observe a display item affixed to said third panel first surface;

wherein said organizer transforms from a fully closed form to a fully opened form by pivoting one-hundred eighty degrees; and, wherein said first panel is adapted to secure said organizer to a wall surface;

locating said wall surface in a home or office offering convenient viewing;

mounting said organizer upon said wall surface in a conventional manner utilizing a plurality of mounting apertures and common purchased fastening hardware;

displaying said first panel by pivoting said second panel outwardly to a left-hand position;

utilizing a plurality of storage compartments and a plurality of hook fixtures of said first panel;

mounting a tray to a first whiteboard surface of said second panel;

loading desired whiteboard supplies and utensils into said tray;

pivoting said second panel to a right-hand position;

displaying and utilizing a first corkboard surface and/or a second corkboard surface of said apparatus to display various items;

utilizing said second panel and said third panel individually or as a combined larger display surface to affix said various items using thumb tacks or push-pins;

reversing said third panel by upwardly extracting, rotating, and reinserting said third panel into a slot to allow utilization of a second whiteboard surface of said third panel;

pivoting said third panel to a right-hand and forward facing position to expose said second whiteboard surface of said third panel;

mounting and displaying decorative items upon said third panel using tape, magnets;

pivoting said fourth panel thereto a right-hand position until attached against said third panel via a magnetic strip, thereby returning said organizer to a closed state; and, viewing various display items through said transparent window.

* * * * *